US010807794B2

(12) United States Patent
Hunter et al.

(10) Patent No.: US 10,807,794 B2
(45) Date of Patent: Oct. 20, 2020

(54) LINER FOR TANK CONTAINER

(71) Applicant: INTERMODAL LINER, LLC, Port Aransas, TX (US)

(72) Inventors: Andrew Hunter, Mt. Pleasant, SC (US); Ronald Stevens, Angleton, TX (US)

(73) Assignee: COMPOSITE CONTAINERS, LLC, Mt. Pleasant, SC (US)

( * ) Notice: Subject to any disclaimer, the term of this patent is extended or adjusted under 35 U.S.C. 154(b) by 248 days.

(21) Appl. No.: 15/888,549

(22) Filed: Feb. 5, 2018

(65) Prior Publication Data

US 2019/0241359 A1 Aug. 8, 2019

(51) Int. Cl.
*B65D 90/04* (2006.01)

(52) U.S. Cl.
CPC ..... *B65D 90/046* (2013.01); *B65D 2590/046* (2013.01)

(58) Field of Classification Search
CPC .... B65D 90/048; B65D 90/046; B65D 90/04; B65D 25/16; B65D 25/14
USPC ..... 220/495.05, 495.01, 1.6, 1.5, 9.4, 586, 220/581
See application file for complete search history.

(56) References Cited

U.S. PATENT DOCUMENTS 2,751,319 A 6/1956 Carlson
2,893,533 A 5/1961 Tisch
3,064,344 A * 11/1962 Arne ..... B21D 51/24 29/421.1
3,167,209 A 1/1965 Jones
3,730,384 A 5/1973 Ramme
3,980,196 A 9/1976 Paulyson et al.
4,054,226 A 10/1977 Bjelland et al.
4,133,451 A 1/1979 Ratter
4,169,006 A * 9/1979 Matsubara ..... C09D 163/00 156/182
4,625,478 A 12/1986 Goode
4,671,733 A 6/1987 Krein
4,674,127 A 6/1987 Yamada et al.
4,698,951 A 10/1987 Everman et al.
4,786,192 A 11/1988 Graves et al.
4,863,339 A 9/1989 Krein
4,884,722 A 12/1989 Podd
(Continued)

FOREIGN PATENT DOCUMENTS

DE 2758189 A1 8/1997
EP 0303160 A2 2/1989
(Continued)

OTHER PUBLICATIONS

Translation of WO2011026965. Moddemann, Mar. 10, 2011, Fig. 1. (Year: 2011).*
(Continued)

*Primary Examiner* — Robert J Hicks
(74) *Attorney, Agent, or Firm* — Tristan A. Fuierer; Olive Law Group, PLLC

(57) ABSTRACT

A liner for a tank container, wherein the tank container is used for the transportation of cargo such as liquids, gases, and flowable solids. The liner is made of a polymeric material and it is sized to fit within the tank container. The liner is secured to the tank container using flexible gland flanges that are sandwiched between the tank body and the cover of the specific hole.

16 Claims, 6 Drawing Sheets

(56) References Cited

U.S. PATENT DOCUMENTS

| | | | | |
|---|---|---|---|---|
| 4,942,978 | A | 7/1990 | Bessette | |
| 4,996,760 | A | 3/1991 | Coleman | |
| 5,028,197 | A | 7/1991 | Krein et al. | |
| 5,040,693 | A | 8/1991 | Podd, Sr. et al. | |
| 5,059,084 | A | 10/1991 | Krein | |
| 5,064,096 | A | 11/1991 | Illing et al. | |
| 5,137,170 | A | 8/1992 | Matias | |
| 5,181,625 | A | 1/1993 | Podd, Sr. et al. | |
| 5,183,176 | A | 2/1993 | Meier et al. | |
| 5,222,621 | A | 6/1993 | Matias | |
| 5,302,029 | A | 4/1994 | Weber et al. | |
| 5,397,020 | A | 3/1995 | Witt | |
| 5,489,037 | A | 2/1996 | Stopper | |
| 5,494,188 | A * | 2/1996 | Sirosh | F17C 1/16 220/590 |
| 5,522,523 | A * | 6/1996 | Nogles | F24H 1/183 220/567.3 |
| 5,529,393 | A | 6/1996 | Polett | |
| 5,701,650 | A | 12/1997 | LaFleur et al. | |
| 5,735,786 | A | 4/1998 | Krueger et al. | |
| 7,086,429 | B2 | 8/2006 | Moizumi | |
| 7,490,990 | B2 | 2/2009 | Moizumi | |
| 8,763,855 | B1 | 7/2014 | Harvey et al. | |
| 9,725,236 | B2 | 8/2017 | Starck et al. | |
| 2005/0184068 | A1 | 8/2005 | Moizumi | |
| 2006/0096993 | A1* | 5/2006 | Takashima | F17C 1/06 220/588 |
| 2007/0023438 | A1 | 1/2007 | Kenneth, Jr. | |
| 2012/0241461 | A1* | 9/2012 | Cola | F17C 13/084 220/582 |
| 2014/0044378 | A1 | 2/2014 | Loeschen et al. | |
| 2017/0320661 | A1 | 11/2017 | Starck et al. | |
| 2018/0220517 | A1* | 8/2018 | Hanlon | H05F 3/02 |

FOREIGN PATENT DOCUMENTS

| | | | | |
|---|---|---|---|---|
| EP | 443709 | A1 | 8/1991 | |
| EP | 0591090 | A2 * | 4/1994 | B65D 90/04 |
| JP | 504615 | | 1/1975 | |
| JP | 5746492 | | 3/1982 | |
| JP | 6148190 | | 3/1986 | |
| JP | 61104983 | | 5/1986 | |
| JP | 2001354292 | | 12/2001 | |
| WO | WO-2011026965 | A2 * | 3/2011 | B64D 37/06 |

OTHER PUBLICATIONS

International Search Report & Written Opinion; International Patent Application No. PCT/US19/16266, dated Apr. 8, 2019.

* cited by examiner

LINER FOR TANK CONTAINER

FIELD

The present invention relates generally to a liner for a tank container including, but not limited to, an ISO tank container, wherein the tank containers are used for the transportation of cargo such as liquids, gases, and flowable solids. The cargo can be hazardous or non-hazardous, and can be consumable or non-consumable. The liner is made of a polymeric material and it is sized to fit within the tank container.

BACKGROUND

In cargo transportation by sea, railroad, road and so forth, a tank container is generally used for liquid materials (cargo). As the tank container, a 20-foot container (hereinafter referred to as a tank container) which conforms to the International Organization for Standardization (ISO) Standards is ordinarily used. The tank container is typically a cylindrical tank mounted in a rectangular frame and is about 20 feet in length, about 8 feet in width, and about 8 feet in height, so that about 20 tons of liquid can be filled therein (see, e.g., FIG. 1).

In the use of this kind of tank container, when filled, such a shipping tank or tank container can be transported by truck, train and/or barge to a port and then loaded on, for example, a container ship for transoceanic transport to another port. The tank container is unloaded from the container ship at the destination port and is emptied of its liquid cargo. The tank container may then be re-used for transporting another liquid cargo, provided such a cargo is available and provided the tank container is in a condition for receiving another cargo. Having a tank container in a condition for receiving another cargo typically involves cleaning the tank at a cleaning station specifically designed for such a purpose. Disadvantageously, cleaning a tank container is a relatively expensive process. Further, the tank containers are made of stainless steel, which is porous and residual contaminants remain in the skin of the stainless steel. Once chemicals, hazardous or non-hazardous, have been shipped in the tank container, it rarely can be reused to transport a different cargo. For example, if the tank container was used to transport a chemical, it cannot be reused to transport a consumable (i.e., food grade) cargo. Similarly, certain chemicals cannot be loaded in the tank container after other chemicals were shipped in the tank container because of compatibility and contamination risks. This often results in "repositioning" of the tank containers, wherein no products are available to be filled in the tank containers once emptied and the tanks have to be shipped to another location, while empty, before they can be refilled due to prior content restriction or no available cleaning facilities.

Another disadvantage of the tank containers of the prior art is that many chemicals, such as low pH liquids and chlorinated solvents, corrode the stainless steel in the tank container. When this happens, the users have to cut out the pitted stainless steel and weld new stainless steel inside the tank. This adds to the costs associated with moving cargo in the tank containers.

To avoid or minimize such cleaning, or to reuse the tank container immediately without the necessity of repositioning or providing a new interior stainless steel skin, many have proposed the installation of flexible liners in the tank containers. That said, it has been difficult to produce successful liners for large tanks. Namely, it has been difficult to produce a liner that fits in the cylindrical tank easily and affordably. The ideal liner to fit within the tank container would be one having approximately the same shape and same volume as the interior of the tank container. However, the liners of the prior art having the same shape as the tank have proven unsuccessful. The use of an envelope type liner has been proposed, but although the envelope type liner is easily produced, if the liner is not formed to have the appropriate size for fitting in the tank container, whether too large or too small, filling failure and breakage of the liner may occur.

Accordingly, there still remains a need in the art for a liner for a tank container. Preferably, the liner is easy to make and easy to install and remove.

SUMMARY

The present invention relates to a liner for a tank container e.g., an ISO tank container, wherein the tank containers are used for the transportation of cargo such as liquids, gases, and flowable solids.

In one aspect, a flexible liner for a tank container is disclosed, said tank container comprising a tank body defining an interior and comprising a length of a cylindrical side wall along a longitudinal axis with substantially domed, circular ends, wherein the flexible liner comprises a length of a side wall that is the same length as the longitudinal axis of the tank body, wherein the length of the side wall comprises a circular cylinder and a first end and a second end that are spaced apart by the length of the side wall, and wherein the side wall at the first end and the second end are each closed by forming seams, thereby defining a liner cavity to accommodate cargo, wherein the flexible liner has substantially the same dimensions and shape as the interior of the tank body.

In another aspect, a method of inserting a flexible liner into a tank container is disclosed, said tank container comprising a tank body defining an interior and comprising a length of a cylindrical side wall along a longitudinal axis with substantially domed, circular ends, wherein the flexible liner comprises a length of a side wall that is the same length as the longitudinal axis of the tank body, wherein the length of the side wall comprises a circular cylinder and a first end and a second end that are spaced apart by the length of the side wall, and wherein the side wall at the first end and the second end are each closed by forming seams, thereby defining a liner cavity to accommodate cargo, wherein the flexible liner has substantially the same dimensions and shape as the interior of the tank body, said method comprising:

removing all of the closing means from the tank body;

folding the flexible liner to fit into the manway opening of the tank body and unfolding the flexible liner in the interior of the tank body;

feeding the liner removal lanyards through the manway opening and securing same externally;

securing a first end of the gland lanyard to a bolt proximate to the top-discharging provision in the tank body and securing the second end of the gland lanyard to the flexible gland flange of the liner top-discharging provision opening in the flexible liner;

pulling the gland lanyard at the top-discharging provision to pull the flexible gland flange through the top-discharging provision;

securing the closing means of the top-discharging provision such that the flexible gland flange is sandwiched between the tank body and the closing means;

inflating the flexible liner at the bottom valve outlet assembly;

pulling the large diameter spout through the manway opening and securing same to the tank body;

pulling the flexible gland flange of the liner bottom outlet valve assembly opening through the bottom outlet valve assembly during inflation;

securing the closing means of the bottom outlet valve assembly such that the flexible gland flange is sandwiched between the tank body and the closing means;

pulling the remaining flexible gland flanges through their respective tank openings in the tank body and securing all but one using closing means, wherein the one that is not closed is intended to be used to fill cargo in the tank container; and ceasing inflation.

In yet another aspect, a method of removing a flexible liner from a tank body of a tank container is disclosed, said tank container comprising a tank body defining an interior and comprising a length of a cylindrical side wall along a longitudinal axis with substantially domed, circular ends, wherein the flexible liner comprises a length of a side wall that is the same length as the longitudinal axis of the tank body, wherein the length of the side wall comprises a circular cylinder and a first end and a second end that are spaced apart by the length of the side wall, and wherein the side wall at the first end and the second end are each closed by forming seams, thereby defining a liner cavity to accommodate cargo, wherein the flexible liner has substantially the same dimensions and shape as the interior of the tank body, said method comprising:

removing cargo from the tank container;

removing the closing means from each of the tank openings;

vacuuming air out of the flexible liner;

pulling the liner removal lanyard attached to the second end of the flexible liner to remove half of the flexible liner through the manway opening, said pulling forcing any excess cargo to flow towards the bottom outlet valve assembly for bottom discharge;

covering the gland flange of the liner bottom outlet valve assembly opening such that no cargo can escape through said liner opening; and pulling the liner removal lanyard attached to the first end of the flexible liner to remove the other half of the flexible liner through the manway opening.

Other aspects and advantages of the invention will be more fully apparent from the ensuing disclosure and appended claims.

DETAILED DESCRIPTION

The present invention relates generally to a liner for a tank container including, but not limited to, an ISO tank container, wherein the tank containers are used for the transportation of products such as liquids, gases, and flowable solids. The products can be hazardous or non-hazardous.

As defined herein, an "envelope type inner bag" is produced only by welding both ends of a tubular film or alternatively, the four edges of two identically sized rectangular films placed atop one another.

Figure 1:
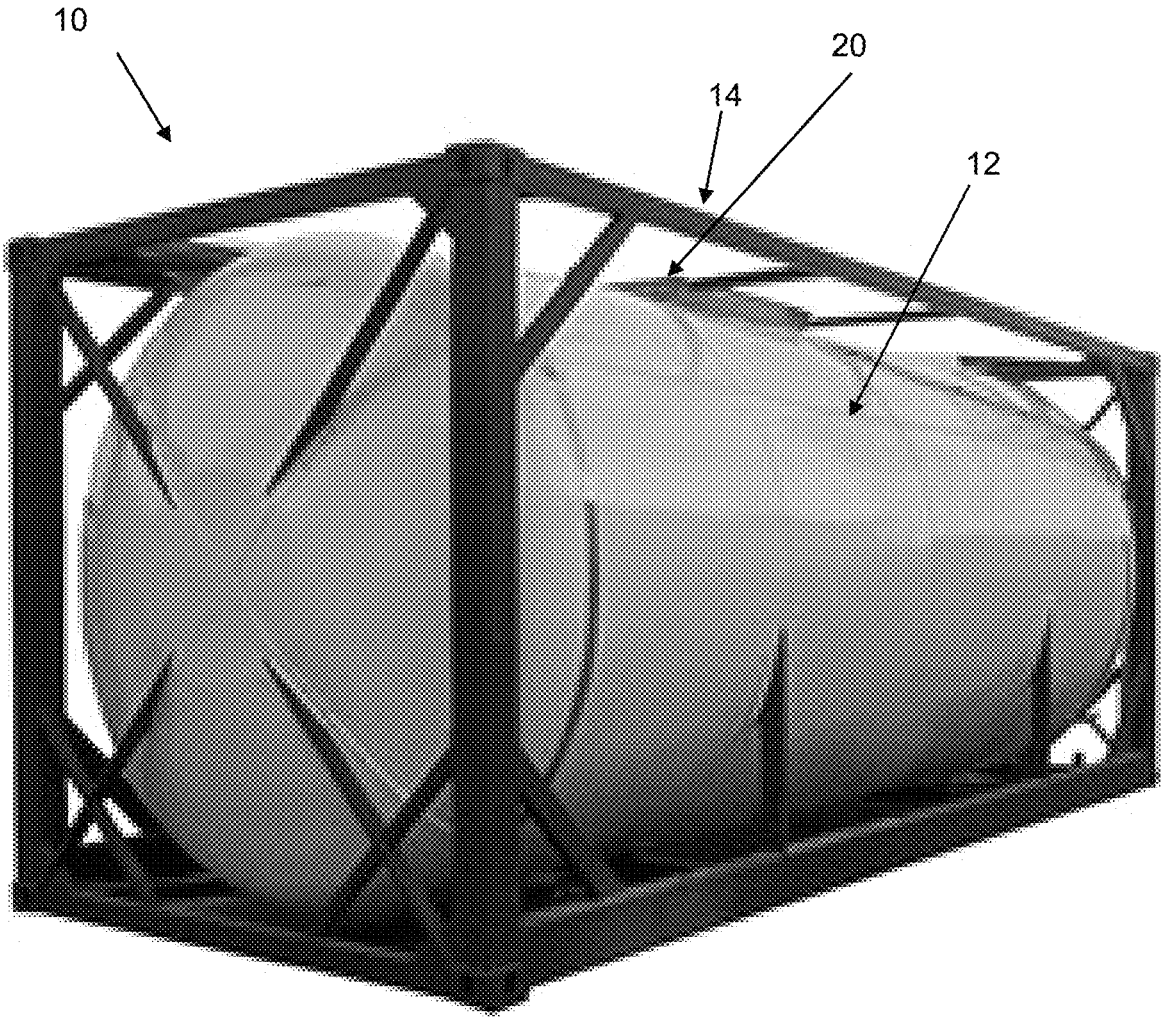
FIG. 1 is a picture of a generic tank container.
Figure 2:
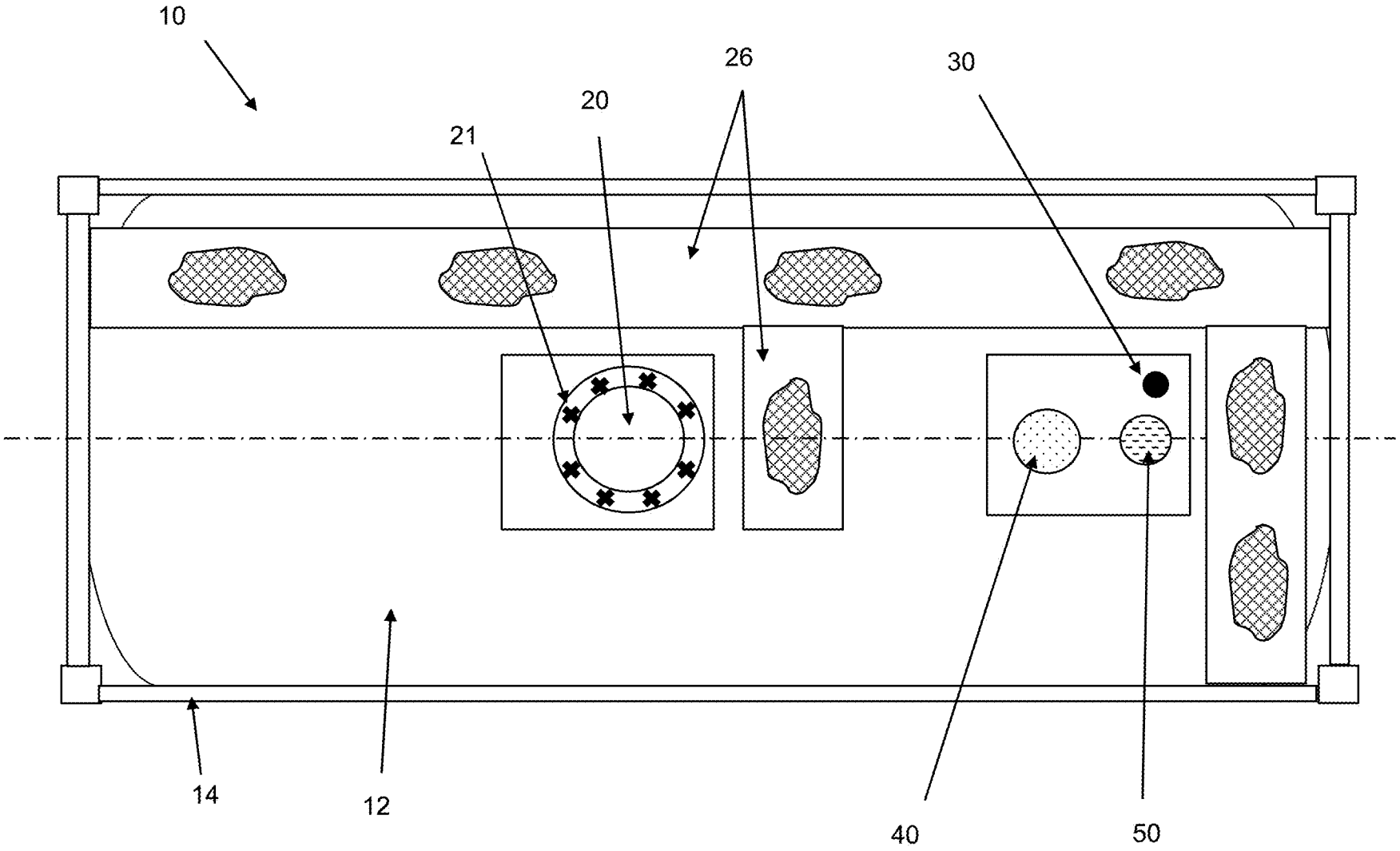
FIG. 2 is an illustration of a top view of a tank container.

In FIG. 1, a general tank container 10 is shown. The tank container 10 includes a tank body or tank 12 and a supporting parallelepiped frame 14. The tank 12 has a cylindrical side wall along a longitudinal axis with opposite ends that are closed by circular end walls, which may be domed, such as is shown in FIG. 1. The side wall and end walls define an tank cavity. The tank container is preferably formed of stainless steel or another material that is structurally strong, substantially rigid, and chemically resistant. The supporting frame 14 can include at least one of a longitudinally-extending member, a laterally-extending member, vertically-extending members, and cross braces. The tank 12 is oriented within the frame 14 such that a manhole or manway 20 is presented upward, as shown approximately in FIG. 1. A catwalk 26 is secured to the frame 14 adjacent the manway 20 to facilitate access to the manway, as seen in FIG. 2. The supporting frame 14 is formed of steel or another material that is structurally strong and substantially rigid. Although one particular configuration of a frame 14 is shown in FIG. 1, other configurations may be used, consistent with applicable national and international standards. The frame 14 provides a strong and stable structure for lifting, moving, and stacking tanks, such as tank 12.

The manway 20 of the tank container is formed in the side wall of the tank 12 to provide access to the tank cavity for a person (not shown). The manway 20 may be covered by a manway lid. At the time of transporting, the manway lid is locked by at least one locking member 21 in order to prevent the lid from opening, e.g., an 8-point fastening man lid. The tank container further includes the following ports: a bottom outlet valve assembly 60 for bottom discharge (see, FIG. 3), which can include a foot valve (not shown); a safety relief valve 30, an air inlet (not shown), and a top-discharging provision 50 (also referred to as a siphon port, a dip tube port or a top outlet valve). Each port includes a removable closing means, for example, a manway lid, a valve or a plate, depending on the specific port, as readily understood by the person skilled in the art. The tanks can further include at least one of an extra port 40, a thermometer (not shown), and a steam heating system (not shown). It should be appreciated that the term "top" corresponds to a position of the tank body that is least susceptible to leaking the cargo out of the tank and that permits as much cargo to be loaded in the tank without losing the cargo to spillage.

To facilitate multiple uses of the tank 12, while minimizing the need for cleaning the tank between uses, a flexible liner 70 (FIG. 5) can be installed in the tank. The liner 70 can be fabricated from flexible polymer tubular or sheet material, which may be from about 2 mil (50.8 micron) to about 12 mil (304.8 micron) in thickness. The polymer sheet material may be formed of one layer or alternatively, multiple layers of the same or different polymers, wherein the multiple layers can be bonded to one another. The liner 70 has a side wall 72 that extends for the length of the liner. The side wall is formed as a tube or loop, like a circular cylinder. The side wall 72 of the liner has a first end 74 and a second end 76 that are spaced apart by the length of the side wall, which is also the length of the liner. The portions of the side wall 72 at the first and second ends (74 and 76) are closed, e.g., by welding such as ultrasonic welding, to form seams, thereby defining an liner cavity. The manufacturing of the flexible liner will be discussed further below. The seams can be about 2 mm to about 20 mm wide, preferably about 6 mm to about 14 mm wide, as readily determined by the person skilled in the art. Preferably, the liner is a single layer of polymer sheet material, whether comprising the same or different polymers.

The flexible polymer sheet material can be any polymeric sheet material including, any polyethylene-containing films, barrier films, perfluoroalkoxy alkane (PFA) films, and polytetrafluoroethylene-based films, including, but not limited to, low-density polyethylene (LDPE), linear low-density polyethylene (LLDPE), high-density polyethylene (HDPE), aluminum (Al), nylon, polyethylene terephthalate (PET), polyethylene terephthalate polyester (PETP), polytrimethylene terephthalate (PTT), polybutylene terephthalate (PBT), or polypropylene (PP), polyvinyl chloride (PVC), polyamide (PA), polyethylene (PE), polystyrene (PS), polypropylene (PP), ethylene vinyl acetate (EVA), ethylene methyl acrylate (EMA), polytetrafluoroethylene (PTFE), TEFLON™, perfluoroalkoxy alkane (PFA), fluorinated ethylene propylene (FEP), and ethylene vinyl alcohol (EVOH), and any combination of the above if a multilayer liner is used. It should be appreciated by the person skilled in the art that the liner should be of a sufficient thickness and material to ensure chemical compatibility with the cargo as well as resistance to breaking or ripping during filling, removal or transit. The cargo may be a wide range of chemical and petroleum products or alternatively, may be consumable products.

Figure 3:
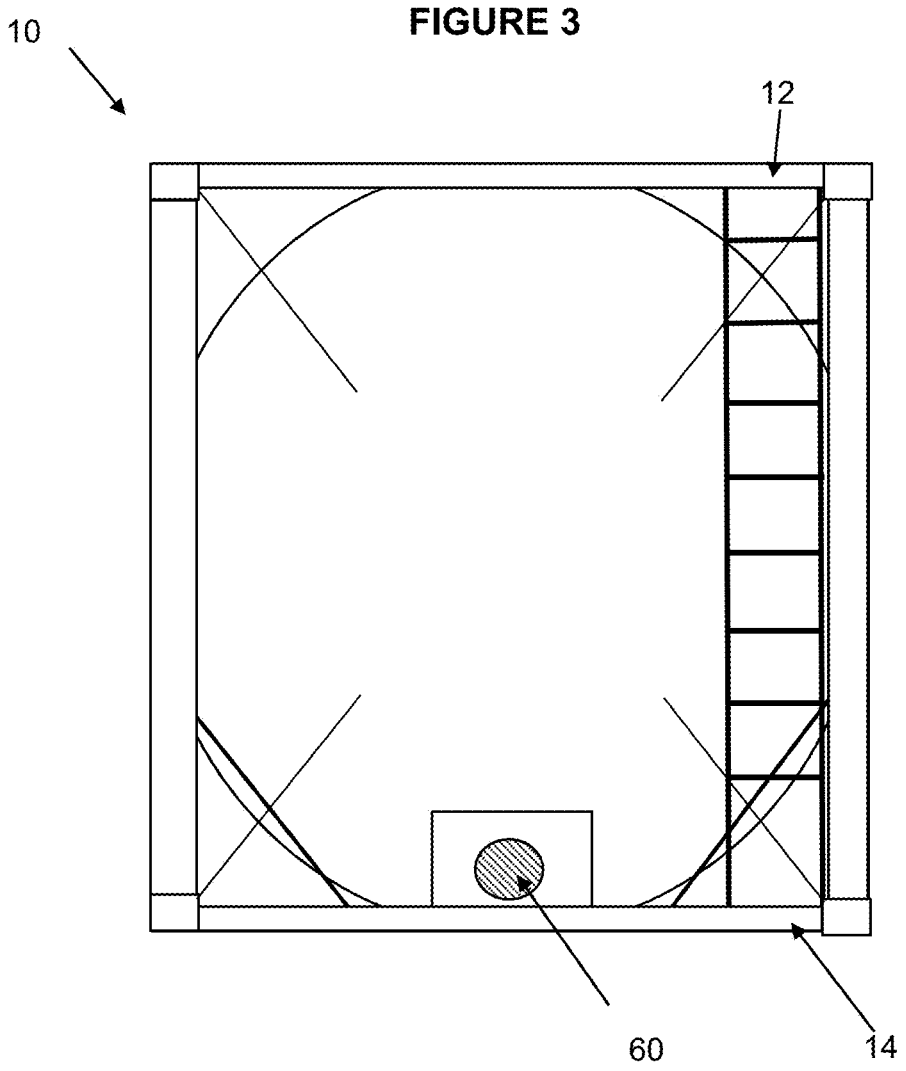
FIG. 3 is an illustration of a second side of a tank container.
Figure 5:
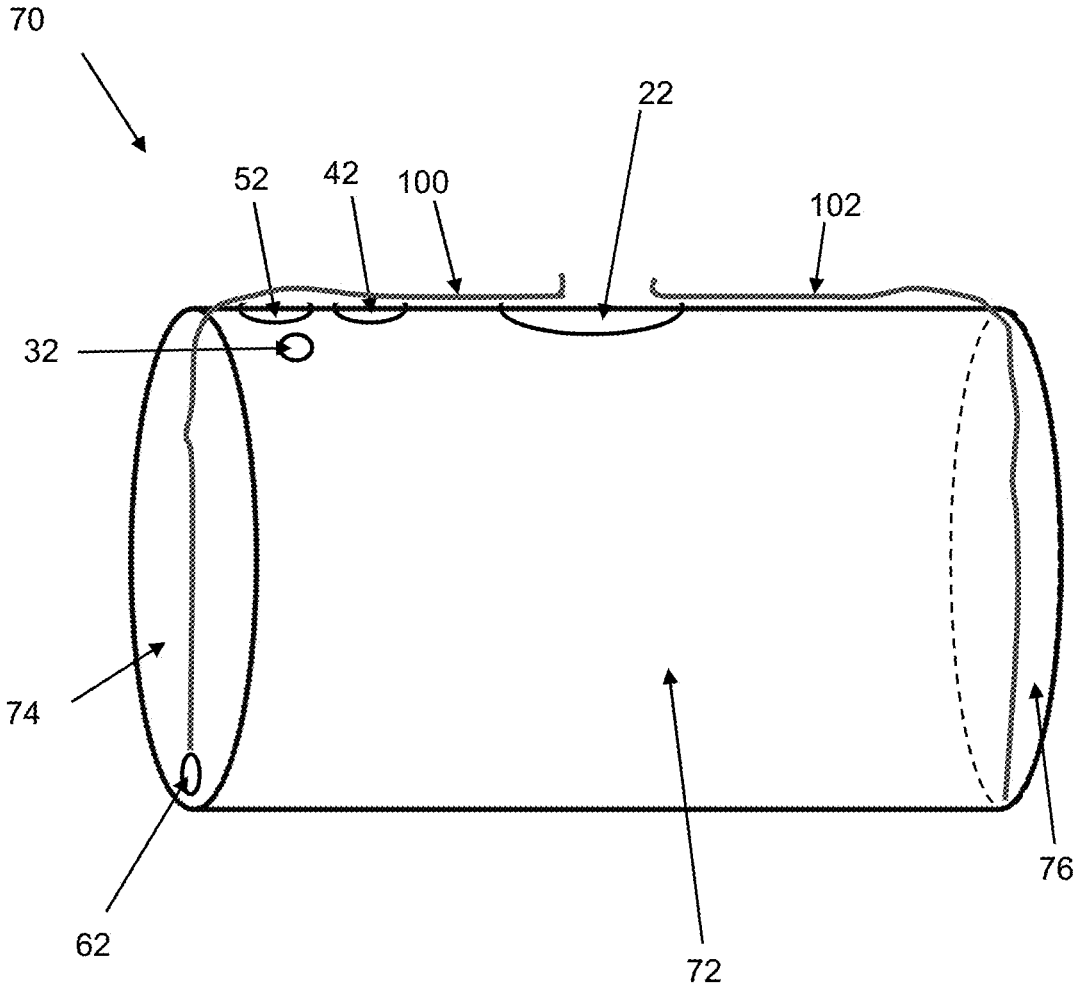
FIG. 5 is an illustration of the liner removal lanyards.

An advantage of the liner described herein is that it has substantially the same dimensions and shape as the interior of the tank of the tank container and there are openings or holes in the liner that correspond with each of the openings in the tank including, but not limited to, the manway (opening 22 in the liner of FIG. 5, which corresponds with 20 in FIG. 2), the top-discharging provision (opening 52 in the liner of FIG. 5, which corresponds with 50 in FIG. 2), the safety-relief valve (opening 32 in the liner of FIG. 5, which corresponds with 30 in FIG. 2), and the bottom outlet valve assembly (opening 62 in the liner of FIG. 5, which corresponds with 60 in FIG. 3). Additional holes in the liner are provided, as needed, for example 42 for extra port 40. It is understood that the size and shape of the liner as well as the location of the holes will change depending on the specific tank container. The liner can further include liner removal lanyards 100, 102, gland lanyards, or both liner removal lanyards and gland lanyards.

In practice, the liner can be manufactured at least one of three ways. A first way involves starting with a tubular film having the same diameter as the interior of the tank body. The tubular film is then welded at both ends. The weld is rounded to match the interior domed, circular end walls. A second way involves starting with a tubular film having the same diameter as the interior of the tank body. Thereafter, a circular piece of film is welded to each end of the tubular film. A third way of preparing the liner involves starting with two, equally sized pieces of flat film (or one larger sheet of film folded along the length or width) and laying the two layers of film on top of one another. A weld to create a tube the size and shape of the interior of the tank body is then completed. Thereafter, the ends are welded (e.g., rounded to match the domed, circular end walls) consistent with the first way of manufacturing the liner or circular pieces of film are welded to each end of the tube consistent with the second way of manufacturing the liner. Preferably, the liner is not a rectangular envelope-type bag with substantially squared corners. After the liner is prepared, the openings in the liner can be positioned and completed and the gland flanges attached thereto, as described hereinafter.

Figure 4A:
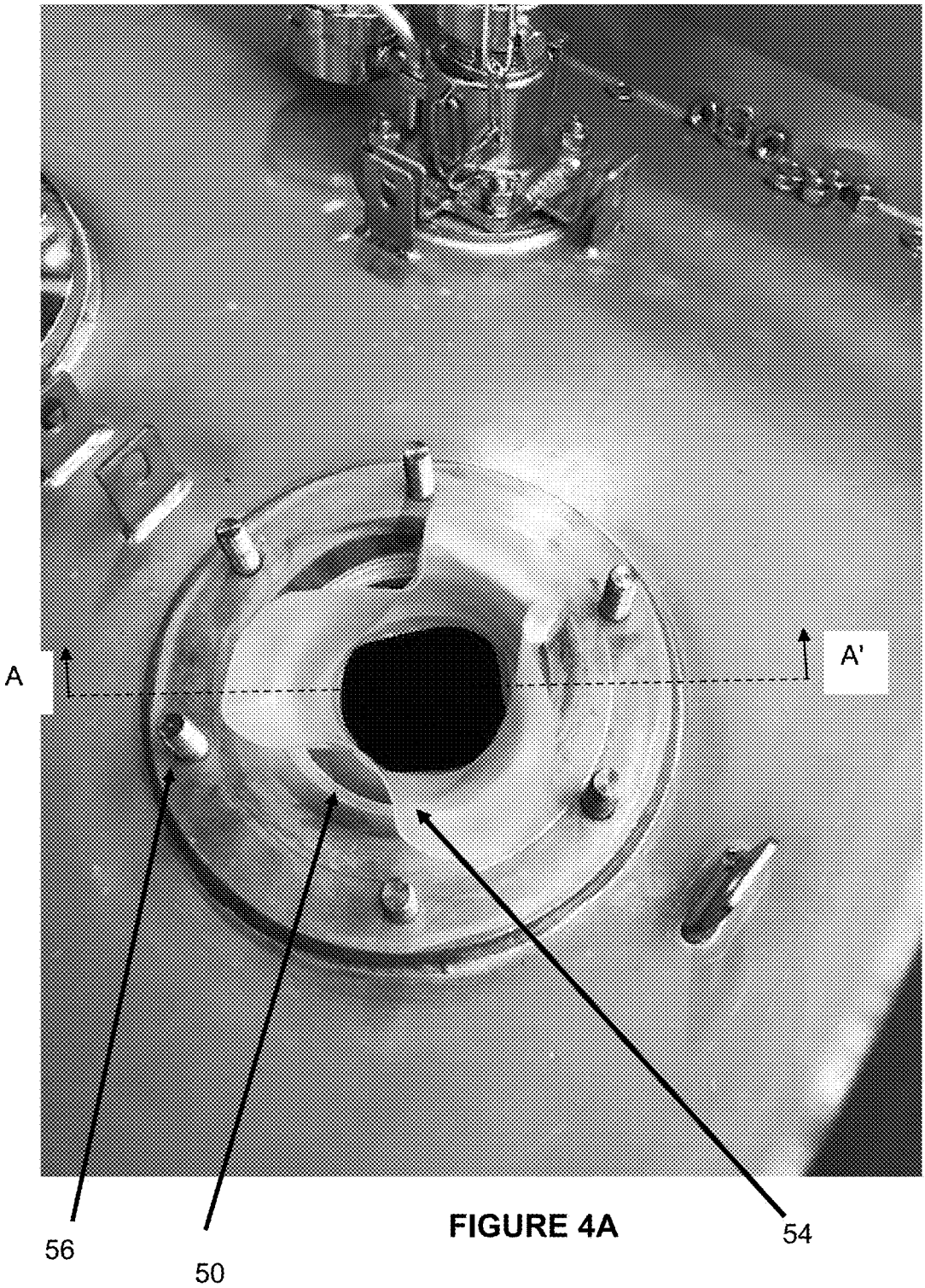
FIG. 4A is a picture of a gland flange emerging from the top-discharging provision 50.

Another advantage of the liner described herein is the inclusion of flexible gland flanges at most of the holes (e.g., 52, 32, 62) of the liner 70. An example of a flexible gland flange is shown in FIG. 4A, wherein the flexible gland flange 54 is attached at opening 52 of the liner 70 (not shown) and can be pulled out of top-discharging provision 50. Referring at FIG. 4B, which is a cross-section of line A-A' in FIG. 4A, the positioning of the flexible gland flange 54 at opening 52 in the liner 70 can be seen, as well as how the gland emerges out of top-discharging provision 50. Advantageously, the flexible nature of the gland flange allows the user to pull the flexible gland flange through the port in the tank body as well as to sandwich the flexible gland flange between the tank body and the closing means, e.g., lid or plate or valve, for the specific port. For example, as shown in FIG. 4C, the plate 58 for top-discharging provision 50 is positioned over the port 50 such that the flexible gland flange is sandwiched between the plate 58 and the tank body, thus holding the flexible gland flange 54 there between, and subsequently, the liner 70, in position during transport. In the case of FIG. 4C, the plate is secured by bolting down the plate at posts 56.

The flexible gland flange can be made using an injection molding tool and can be welded to the opening in the liner. The flange can be manufactured from any of the flexible polymer sheet materials disclosed hereinabove for the liner, and preferably has a substantially similar melt temperature as the flexible polymer sheet material of the liner. Preferably, the flexible gland flange is shaped like a circular ring or a two-dimensional donut, having an inner radii and an outer radii, wherein (2×inner radii) is approximately equal to the diameter of the respective hole of the liner that the flexible gland flange is to be attached to, and the outer diameter is greater than the inner diameter such that it can be sandwiched between the tank body and the respective closing means, e.g., lid or plate or valve.

Figure 4B:
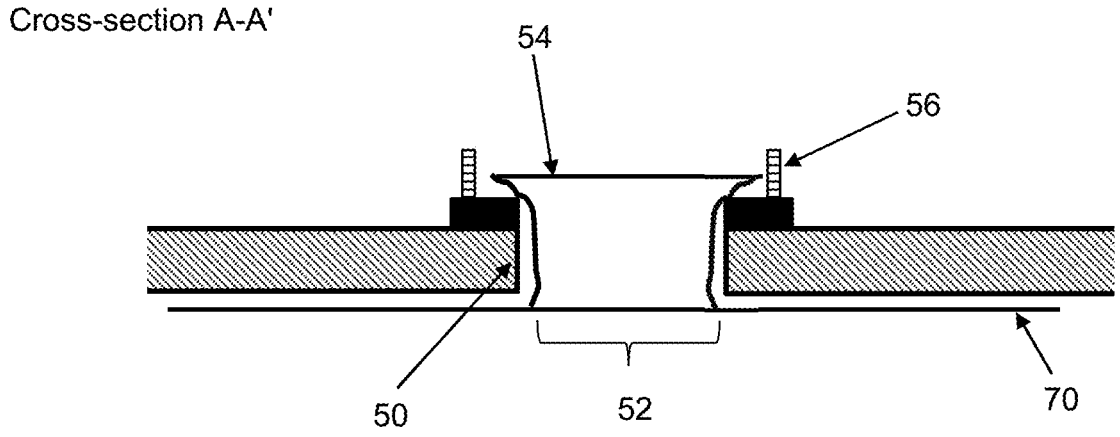
FIG. 4B is an illustration of the cross-section of A-A' of FIG. 4A showing the gland flange in the top-discharging provision port.
Figure 4C:
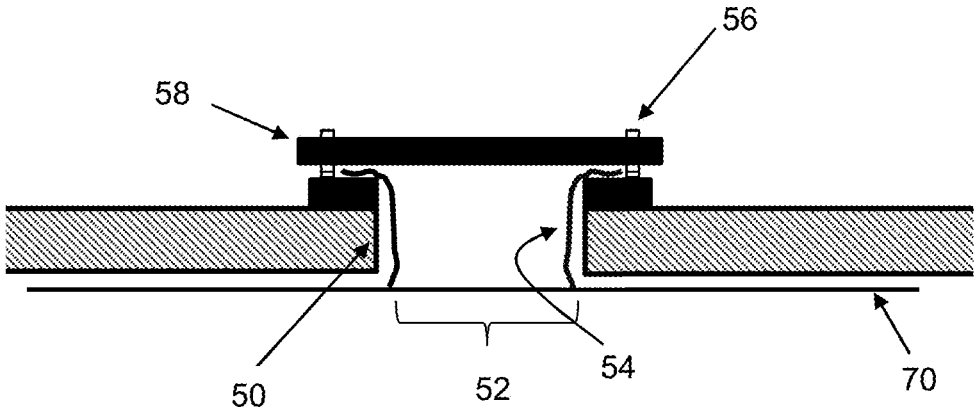
FIG. 4C is an illustration of the positioning of the gland flange of FIG. 4B during closure of the top-discharging provision port.

It should be appreciated that FIGS. 4A-4C illustrate and describe the flexible gland flange at top-discharging provision 50, however, each of the other ports in the tank body that have a corresponding hole in the liner and a flexible gland flange that can emerge from the respective port, can be sandwiched between the closing means, e.g., lid or plate or valve, and the tank body.

Although it is contemplated that the flexible gland flange described hereinabove could be used for the manway opening 20 as well, preferably for the manway opening 20, a large diameter spout can be welded to the opening of the liner 22. The spout can be made from the same or different material the liner is made from, as readily determined by the person skilled in the art. The manway spout is secured to the lip of the manway entrance 20 using securing means known in the art including, but not limited to, double sided tape, putty, a rubber U-channel, or a vinyl U-channel.

In addition, liner removal lanyards can be attached to the liner prior to use. The liner removal lanyards can be any material including, but not limited to, ropes or other fibrous material that are twisted or braided together to create a stronger material. The fibrous material or ropes can be woven and can be a natural material or a polymeric material or a mixture of both. Preferably, the material of the liner removal lanyard is of sufficient strength and thickness that it will not break as the liner is pulled through the manway. The liner removal lanyards can be attached to the liner at the appropriate location using tape or welding belt loops wherein the lanyards are run through the loops. The appropriate location for attachment will be discussed hereinafter with regards to the removal of the liner.

To insert the liner 70 in the tank body 12, the liner is folded such that it is small enough to be inserted into the manway opening 20. Any protrusions or sharp ends on the interior of the tank body are preferably removed by grinding or are covered, e.g., using tape or other adhesive means. Once in the tank body, the liner is unfolded across the length and width of the tank body. All of the closing means, e.g., valve or lid or plates, are removed from the tank body, e.g., the bottom outlet valve assembly, the safety relief valve, the air inlet valve, and the top-discharging provision, and any others. The liner removal lanyards 100, 102 are fed through the manway port 20 and are secured externally, e.g., to bolts surrounding the manway port, during the filling and removal processes.

Because it is difficult to align the flexible gland flanges with their respective ports, one or more of the smaller flexible gland flanges can be pulled through their respective ports in the tank body using gland lanyards. For example, once the closing means, e.g., lid or valve or plate, is removed, a first end of a gland lanyard is secured to a bolt next to the respective port in the tank body. The second end of the lanyard is dropped into the tank through the specific port. Once inside, the user secures or ties the second end of the lanyard to the corresponding flexible gland flange. The gland lanyards can be any material including, but not limited to, ropes or other fibrous materials that are twisted or braided together to create a stronger material. The fibrous materials or ropes can be woven and can be a natural material or a polymeric material or a mixture of both. Preferably, the material of the gland lanyard is of sufficient strength and thickness that it will not break as the gland flange is pulled through the specific port.

In one embodiment, the top-discharging provision gland flange is positioned as described in the foregoing paragraph. Thereafter, the top-discharging provision valve is secured to the tank body and the liner can be inflated. The location of inflation is readily determined by the person skilled in the art. In one embodiment, the location of inflation is the bottom outlet valve assembly 60. As inflation occurs, the corresponding flexible gland flange for the bottom outlet valve assembly (not numbered) can be pulled through the port 60, e.g., using a gland lanyard, and the valve secured, wherein the flexible gland flange is sandwiched between the valve and the tank body. Any additional ports that can or should be sealed are then closed, in a manner similar to that described for the top-discharging provision valve and the bottom outlet valve assembly. The source of the inflation air is dependent on the cargo. The air can be provided from an electric or battery-powered air blower or compressor. If the air must be "clean," a clean air compressor can be used to inflate the liner. Once all glands are in position and the corresponding accessories are bolted back on to the tank, all valves can be closed and then the inflation process is ceased.

Advantageously, there is no opening or closing of the liner described herein. The liner will always have the holes with the flexible gland flanges and large diameter spout (for manway) attached thereto, and the holes are never sealed to yield a liner having no holes. Instead, the flexible gland flanges are pulled through the ports of the tank body and are sandwiched between the tank body and the closing means, e.g., valve or plate or lid, of the specific port during closure, as described herein with reference to FIGS. 4A-4C. The portions of the flexible gland flanges that are sandwiched can therefor act as a gasket between the tank body and the closing means, e.g., valve or lid or plate, of the specific port. Another advantage is that the liner is filled without attaching hoses or piping to a valve provided in the liner and the tank container is transported without said hose or piping remaining inside the tank container during transit. This increases the available volume for cargo as well as minimizes the risk of the liner being ripped or pinched by said hose or piping, which may result in damage to the liner and the unintended release of the cargo within the tank body Once the liner is in place within the tank body, the cargo is loaded into the liner using the preferred port, as readily known to the person skilled in the art, and when filled properly with the cargo, the liner walls will be pressed tightly against the interior walls of the tank without any substantial portion of the liner walls being under tension. This minimizes or eliminates any force on the welds or the structure of the film, thereby ensuring that the liner will not break during filling, removal or transit of the cargo. As disclosed herein, the liner bag preferably has the same shape and volume as the interior of the tank body. If the liner is too small, the cargo may move in transit, thus ripping the liner. If the liner is too large, liner material is wasted and the excess liner material takes up volume in the tank body, displacing some of the cargo that is to be transported and causing residual cargo to be left in the tank after the contents have been discharged.

Following filling, the filling port(s) is closed, as described herein where the flexible gland flange is sandwiched between the tank body and the closing means, e.g., valve or lid or plate, of the specific port or by closing the manway lid to secure the spout between the manway lid and the tank body. The tank container is now ready for transit.

Once the tank container reaches the final destination, the cargo can be removed from the bottom outlet valve assembly 60 for bottom discharge, which can include a foot valve (not shown); using the top-discharging provision 50; or using the manway 20. Either way, once the cargo is almost fully removed from the liner, there is a preferred process of removing the remaining the cargo as well as removing the liner from the tank body. The process involves the use of the liner removal lanyards 100, 102 which upon opening the manway lid should still be accessible to the user. Once the cargo in the liner is substantially removed, all of the lids and valves and plates that are holding the flexible gland flanges, and hence the liner, in place are removed. The air in the liner is vacuumed or withdrawn out through the bottom outlet valve assembly 60 to collapse the liner. Then the lanyard 102 attached to the second end 76 is pulled up from the manway to remove half of the liner.

Preferably lanyard 102 is attached at least to the second end of the liner at a position distal to the "top" of the tank body, and more preferably is attached not only at the second end of the liner at a position distal to the top of the tank body, but has additional attachments along the second end of the liner to distribute the load. This forces any excess cargo to flow towards the bottom outlet valve assembly 60 for bottom discharge and because of the positioning of the lanyard 102, the maximum amount of excess cargo can be removed. Once half of the liner is out, the gland flange that corresponds to the bottom outlet valve assembly 60 is covered, e.g., with a bag or other means whereby the cargo cannot escape the bottom outlet valve assembly hole, and then the lanyard 100 for the first end 74 is pulled up from the manway. Preferably lanyard 100 is attached at the bottom outlet opening 62 hole, and more preferably is attached at the bottom outlet opening hole and as additional attachments along the first end of the liner to distribute the load. In one embodiment, lanyard 100 can be attached using tape or multiple loops, wherein the lanyard is circumscribingly attached to the hole 62. Advantageously, the removal of the liner from the tank body can be accomplished while ensuring that the cargo does not come in contact with the interior of the tank body.

Although the invention has been variously disclosed herein with reference to illustrative embodiments and features, it will be appreciated that the embodiments and features described hereinabove are not intended to limit the invention, and that other variations, modifications and other embodiments will suggest themselves to those of ordinary skill in the art, based on the disclosure herein. The invention therefore is to be broadly construed, as encompassing all such variations, modifications and alternative embodiments within the spirit and scope of the claims hereafter set forth.

That which is claimed is:

1. A flexible liner for a tank container, said flexible liner comprising a cylindrical side wall and two circular end walls, wherein the cylindrical side wall comprises a circular cylinder having a first end and a second end that are spaced apart by a length along a longitudinal axis, and wherein the cylindrical side wall at the first end is sealed to a first circular end wall by seams and the cylindrical side wall at the second end is sealed to a second circular end wall by seams, thereby defining a cavity to accommodate cargo, wherein the flexible liner further comprises at least one opening selected from the group consisting of a liner manway opening, a liner bottom outlet valve assembly opening, a liner safety relief valve opening, a liner air inlet opening, a liner top-discharging provision opening, and any combination thereof, and wherein at least one opening of the flexible liner further comprises a flexible gland flange attached thereto.

2. The flexible liner of claim 1, wherein the seams are welded.

3. The flexible liner of claim 1, wherein the seams are about 2 mm to about 20 mm wide.

4. The flexible liner of claim 1, wherein the flexible liner is fabricated from flexible polymer sheet material.

5. The flexible liner of claim 4, wherein the flexible polymer sheet material may be formed of one layer or multiple layers of the same or different polymers, wherein the multiple layers can be bonded to one another.

6. The flexible liner of claim 4, wherein the flexible polymer sheet material comprises any polymeric sheet material selected from the group consisting of polyethylene-containing films, barrier films, perfluoroalkoxy alkane (PFA) films, PTFE-based films, and combinations thereof.

7. The flexible liner of claim 4, wherein the flexible polymer sheet material comprises any polymeric sheet material selected from the group consisting of low-density polyethylene (LDPE), linear low-density polyethylene (LLDPE), high-density polyethylene (HDPE), aluminum (Al), nylon, polyethylene terephthalate (PET), polyethylene terephthalate polyester (PETP), polytrimethylene terephthalate (PTT), polybutylene terephthalate (PBT), or polypropylene (PP), polyvinyl chloride (PVC), polyamide (PA), polyethylene (PE), polystyrene (PS), polypropylene (PP), ethylene vinyl acetate (EVA), ethylene methyl acrylate (EMA), ethylene vinyl alcohol (EVOH), polytetrafluoroethylene (PTFE), perfluoroalkoxy alkane (PFA), fluorinated ethylene propylene (FEP), and any combination thereof.

8. The flexible liner of claim 1, wherein the flexible liner is from about 2 mil (50.8 micron) to about 12 mil (304.8 micron) in thickness.

9. The flexible liner of claim 1, wherein the flexible liner further includes at least one liner removal lanyard and at least one gland lanyard.

10. The flexible liner of claim 1, wherein the first and second circular end walls are substantially domed.

11. The flexible liner of claim 1, wherein the flexible gland flange is welded to the opening.

12. The flexible liner of claim 1, further comprising a large diameter spout joined to the manway opening of the flexible liner.

13. The flexible liner of claim 1, further comprising two liner removal lanyards, one attached to the first end and one attached to the second end of the flexible liner.

14. A method of inserting a flexible liner of claim 1 into a tank container, said method comprising:

removing all closing means from the tank container;

folding the flexible liner to fit into a manway opening of the tank container and unfolding the flexible liner inside the tank container;

feeding liner removal lanyards through the manway opening of the tank container and securing same externally;

securing a first end of a gland lanyard to a bolt proximate to a top-discharging provision of the tank container and securing a second end of the gland lanyard to a flexible gland flange attached to the liner top-discharging provision opening;

pulling the first end of the gland lanyard at the top-discharging provision to pull the flexible gland flange through the top-discharging provision;

securing closing means of the top-discharging provision such that the flexible gland flange is sandwiched between the tank container and said closing means;

inflating the flexible liner at a bottom valve outlet assembly;

pulling a large diameter spout through the manway opening of the tank container and securing same externally;

pulling a flexible gland flange attached to the liner bottom outlet valve assembly opening through the bottom outlet valve assembly during inflation;

securing closing means of the bottom outlet valve assembly such that the flexible gland flange of the liner bottom outlet valve assembly opening is sandwiched between the tank container and said closing means;

pulling any remaining flexible gland flanges through their respective tank container openings and securing all but one using the respective closing means, wherein the one that is not closed is intended to be used to fill cargo in the tank container; and ceasing inflation, wherein the closing means comprise one of a lid, a valve, or a plate.

15. A method of removing a flexible liner of claim 1 from a tank container, said method comprising:

removing cargo from the tank container;

removing all closing means from the tank container;

vacuuming air out of the flexible liner;

pulling a liner removal lanyard attached to the second end of the flexible liner to remove half of the flexible liner through a manway opening, forcing any excess cargo to flow towards a bottom outlet valve assembly for bottom discharge;

covering a gland flange attached to the liner bottom outlet valve assembly opening such that no cargo can escape through said liner opening; and pulling a liner removal lanyard attached to the first end of the flexible liner to remove the other half of the flexible liner through the manway opening, wherein the closing means comprise one of a lid, a valve, or a plate.

16. The flexible liner of claim 1, wherein the flexible gland flange comprises a two-dimensional, substantially circular ring having an inner radii and an outer radii, wherein (2 x inner radii) is approximately equal to a diameter of the at least one opening the flexible gland flange is attached to.

* * * * *